US007314152B1

(12) United States Patent
Garrett

(10) Patent No.: US 7,314,152 B1
(45) Date of Patent: Jan. 1, 2008

(54) HOLSTER FOR A GUN

(76) Inventor: Gregg A. Garrett, 2441 McAllester, Suite L, Houston, TX (US) 77092

( * ) Notice: Subject to any disclaimer, the term of this patent is extended or adjusted under 35 U.S.C. 154(b) by 587 days.

(21) Appl. No.: 10/855,307

(22) Filed: May 28, 2004

(51) Int. Cl.
*F41C 33/02* (2006.01)

(52) U.S. Cl. ..... 224/192; 224/669; 224/672; 224/911

(58) Field of Classification Search ..... 224/192, 224/193, 195, 198, 238, 243, 269, 587, 666, 224/669, 677, 667, 911, 912
See application file for complete search history.

(56) References Cited

U.S. PATENT DOCUMENTS

| | | | | | |
|---|---|---|---|---|---|
| 3,276,646 | A * | 10/1966 | Coggins, Jr. | ..... | 224/579 |
| 3,300,109 | A * | 1/1967 | Clark | ..... | 224/667 |
| 3,942,692 | A * | 3/1976 | Chica | ..... | 224/243 |
| 4,022,361 | A * | 5/1977 | Devlin | ..... | 224/192 |
| 4,258,871 | A * | 3/1981 | McMahon | ..... | 224/192 |
| 4,785,983 | A * | 11/1988 | DeSantis | ..... | 224/604 |
| 5,038,985 | A * | 8/1991 | Chapin | ..... | 224/669 |
| 5,054,671 | A | 10/1991 | Else | | |
| 5,331,721 | A * | 7/1994 | Raum, Sr. | ..... | 24/3.12 |
| 5,598,958 | A | 2/1997 | Ryan, III et al. | | |
| 5,611,471 | A * | 3/1997 | French | ..... | 224/243 |
| 5,865,357 | A * | 2/1999 | Goodwin | ..... | 224/587 |
| 6,089,432 | A | 7/2000 | Gage et al. | | |
| 6,092,703 | A | 7/2000 | Johnson | | |
| 6,264,079 | B1 | 7/2001 | Skaggs | | |
| 6,588,639 | B2 | 7/2003 | Beletsky et al. | | |
| 6,964,361 | B2 * | 11/2005 | Kathrein | ..... | 224/183 |
| 2004/0134945 | A1 * | 7/2004 | Kincaid et al. | ..... | 224/269 |

* cited by examiner

*Primary Examiner*—Nathan J. Newhouse
*Assistant Examiner*—Justin M. Larson
(74) *Attorney, Agent, or Firm*—Egbert Law Offices

(57) ABSTRACT

A holster for a gun has a body with an interior suitable for the receipt of the gun therein, a belt-receiving first clip assembly removably affixed to one side of the body, and a belt-receiving second clip assembly removably affixed to an opposite side of the body. The clip assemblies are adjustably positioned relative to the body. Each of the clip assemblies includes a clip member and a flexible tab connected to the respective opposite sides of the body.

8 Claims, 2 Drawing Sheets

FIG. 1
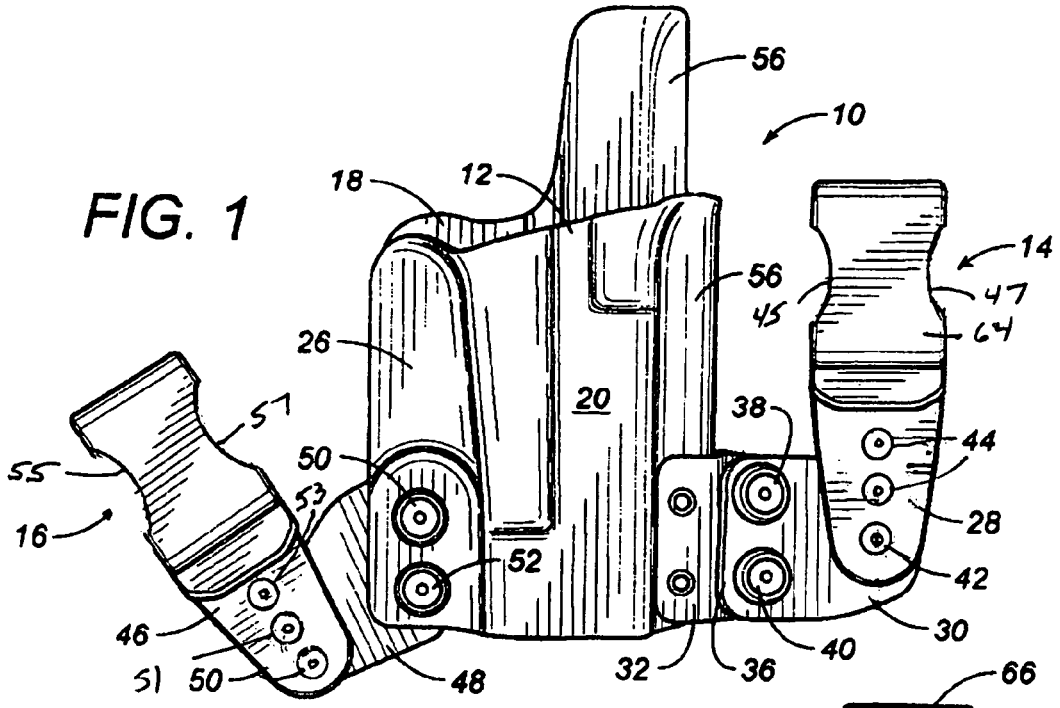
FIG. 2
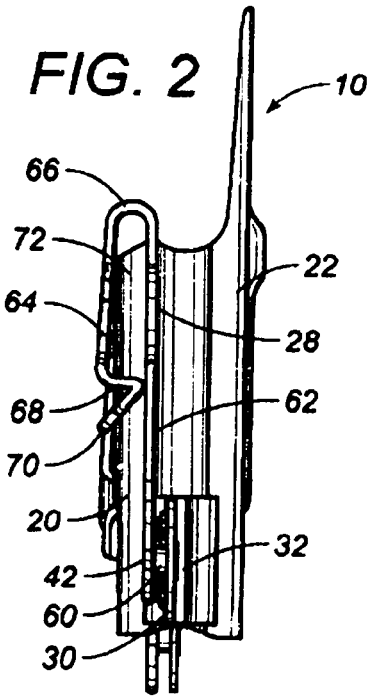
FIG. 3
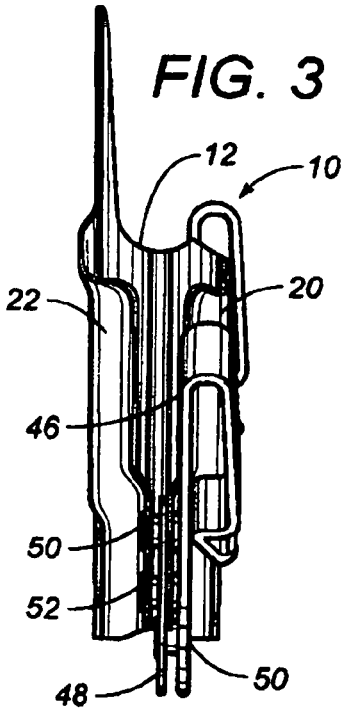
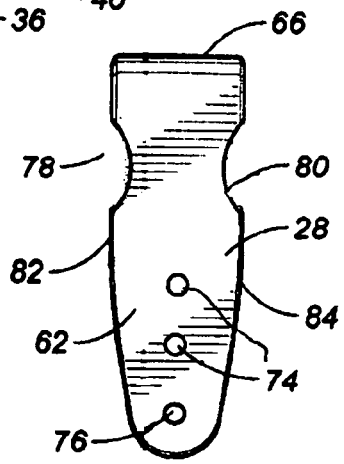
FIG. 4
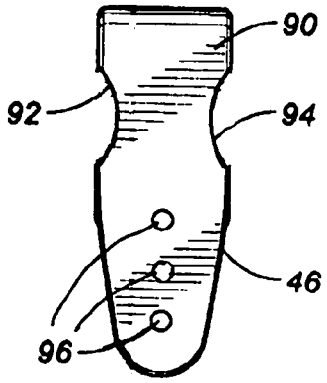
FIG. 5
FIG. 6
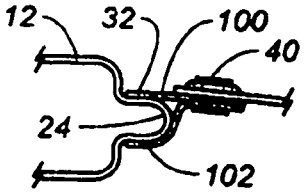

HOLSTER FOR A GUN

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to holster for securing guns to a human body. More particularly, the present invention relates to generally rigid polymeric holster bodies having belt-receiving clips affixed thereto. Additionally, the present invention relates to holsters for concealed handguns.

BACKGROUND OF THE INVENTION

Holsters intended for discretely carrying a defensive handgun have been in existence since guns were first made small enough for concealed carry. Today, such holsters are used by both plainclothes or off-duty police officers and by an increasing number of private citizens who have felt a need to take precautions to ensure their safety.

Most people who carry a handgun prefer to carry it at belt level, positioned on or slightly behind the strong side hip. A few prefer to carry the gun on or slightly in front of the weak side hip, commonly known as a crossdraw carry.

On of the most popular styles of concealment holsters is the inside waist band holster. Such holsters are worn inside the waist band of the wearer's pants, slightly behind the strong side hip, with only the upper lip of the holster and grip of the gun protruding from the pants. A belt clip or loop secures the holsters to the wearer's belt. The top of the holster is covered by a jacket, sweater, or an untucked shirt. This type of holster is especially popular with police, because the draw from this type of holster is very similar to the draw from a duty holster, providing for simplified training and practice.

To be truly useful, such a holster must be able to perform several functions well. First, it must be easily concealed to avoid unnecessarily alarming causal observers, which is accomplished in part by keeping the thickness of the holster's body to a minimum. Second, it must be comfortable to wear for long periods of time. Third, it must hold the gun securely in place. Fourth, it must provide quick access to the gun so that the wearer can respond properly to unexpected emergencies. All of the above functions are most easily accomplished when the holster is properly fitted for the gun to be carried.

Current holsters are generally one of two types: those precisely molded to the gun that they are intended to carry, and those intended to fit any gun within a certain size range. In the past, the first category has proven extremely popular for the most popular types of guns. However, it is important that such precisely molded holster bodies are configured to fit the needs of the user. Additionally, such types of holsters must be able to manufactured in a relatively quick and inexpensive manner. It is important to be able to make the holster suitably adaptable to the various needs of the users. The clips used to secure the holster body to the belt must be of interchangeable and adjustable type so that the various angles can be configured to fit the human body in the most appropriate manner possible.

In the past, various patents have issued relating to such holsters for handguns. For example, U.S. Pat. No. 5,054,671, issued on Oct. 8, 1991 to R. L. Else, teaches a quick-draw handgun holster which is contoured and designed to be worn beneath clothing in the abdominal area. The gun lies obliquely with its butt only extending angularly outwardly for engagement by lateral, substantially horizontal movement of the hand of the wearer.

U.S. Pat. No. 5,598,958, issued on Feb. 4, 1997 to Ryan et al., teaches a competition holster. This holster has a belt loop assembly including mating partial spherical surfaces securing the holster body for universal spherical angular adjustment.

U.S. Pat. No. 6,089,432, issued on Jul. 18, 2000 to Gage et al., teaches a concealment holster constructed from a support member sandwiched between a glove and thumb break member and a paddle member having outwardly extending wings. The lower portion of the glove and thumb break and the wings are worn beneath the trousers of the wearer below the waist with the handgun enclosure extending above the waist of the trousers.

U.S. Pat. No. 6,092,703, issued on Jul. 25, 2000 to A. L. Johnson, teaches a holster having a reinforced front portion to prevent the holster from collapsing under pressure from the wearer's belt when the gun is drawn. The holster is formed of rigid leather and molded to conform to the specific gun intended to be carried. The reinforcement is particularly desirable for wear inside the waistband. A single central or rearward belt loop is provided with one mounted in the front and the other at the rear.

U.S. Pat. No. 6,264,079, issued on Jul. 24, 2001 to J. O. Skaggs, teaches a size adjustable holster for carrying a wide variety of handguns. The holster's body has a flat sheet with corresponding hook-and-loop fasteners on each side. A clip is attached to the body for securing the holster to the wearer's clothing.

U.S. Pat. No. 6,588,639, issued on Jul. 8, 2003 to Beletski et al., teaches a molded holster belt loop assembly with a shelf. The belt loop assembly has a tapered belt loop opening and a platform upon which the belt rests. The taper aids in fixedly positioning the assembly along the belt while the platform protects the belt from wear due to belt positioning screws.

It is an object of the present invention to provide a holster that is convenient and comfortable.

It is another object of the present invention to provide a holster which is suitably flexibly and adaptably adjusted to the human body and the needs of the particular user.

It is a further object of the present invention to provide a holster that has clips that have a long life and avoid cracking.

It is a further object of the present invention to provide a holster whereby the clips are secured to the body in a screw-less, efficient and secure manner.

It is still a further object of the present invention to provide a holster which is easy to use, relatively inexpensive, and easy to manufacture.

These and other objects and advantages of the present invention will become apparent from a reading of the attached specification and appended claims.

BRIEF SUMMARY OF THE INVENTION

The present invention is a holster for a gun comprising a body with an interior for the receipt of the gun therein, a belt-receiving first clip assembly removably affixed to one side of the body, and a belt-receiving second clip assembly removably affixed to an opposite side of the body. The first and second clip assemblies are adjustably positioned relative to the body.

Each of the first and second clip assemblies includes a clip member and a flexible tab having a one side affixed to the clip member. The flexible tab is formed of a leather material. The first clip assembly includes a bracket that is ultrasonically welded to one side of the body. The flexible tab is secured to a portion of the bracket extending outwardly of the body. The clip member is secured by a screw to a flexible tab. The flexible tab is secured by a pair of screws to the portion of the bracket. The flexible tab of the second clip assembly is secured between the front surface and the back surface of the body.

The clip member has a rear surface secured to the flexible tab. The clip member also has a forward surface extending in generally parallel relationship to the front surface. The forward rear surface have a relief formed therethrough and spaced from a resilient junction of the forward and the rear surfaces. This relief, in the preferred embodiment, is a pair of arcuate-shaped cut-outs formed along respective opposite sides of the rear surface. Also, a pair of arcuate-shaped cut outs are formed along opposite sides of the forward surface.

In one form of the present invention, the clip member has an inwardly extending ledge extending from the bottom of the forward surface back toward the rear surface. The clip member has an outwardly angled portion extending from the ledge back away from the rear surface. In an alternative form of the present invention, the clip member has a belt receptacle at the forward surface. This belt receptacle has an outwardly turned portion extending away from the rear surface and extending upwardly for less than the length of the forward surface. In a variation on this embodiment of the clip member, this clip member also includes a shelf extending from the forward surface away from the rear surface. The shelf is in spaced relationship to the outwardly turned portion. In still another form of clip member of the present invention, the clip member includes a section of hook-and-loop material affixed to the forward surface such that either a loop material or a hook material of the section faces away from the rear surface.

The rear surface of the clip member has a lower portion that is affixed to the tab. This lower portion includes at least one hole formed therethrough. In a preferred embodiment of the present invention, the lower portion of the rear surface includes three holes formed therein in generally vertical alignment.

The first clip assembly extends in generally parallel relationship with respect to one side of the body. The second clip assembly extends in an offset angular relationship to the opposite side of the body. The actual angular relationship between the second clip assembly and the body is suitably adjustable to fit the needs of the user. In the present invention, each of the clip members used in the first and second clip assemblies, along with the body, are formed of a rigid polymeric material.

BRIEF DESCRIPTION OF THE SEVERAL VIEWS OF THE DRAWINGS

FIG. 1 is a frontal view showing the holster in accordance with the preferred embodiment of the present invention.

FIG. 2 is an end view of the holster of the present invention.

FIG. 3 is an opposite end view of the holster of the present invention.

FIG. 4 is an isolated rear view of the clip member of the first clip assembly of the preferred embodiment of the present invention.

FIG. 5 is a rear view of the clip member of the second clip assembly of the preferred embodiment of the present invention.

FIG. 6 is a view of a portion of the bottom of the holster of the present invention showing the ultrasonic welding of the bracket to the side of the body of the holster.

DETAILED DESCRIPTION OF THE INVENTION

Figure 7:
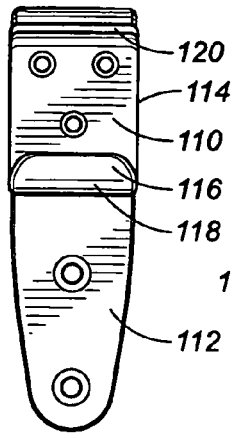
FIG. 7 is a frontal view of a first alternate clip used in the present invention.

Referring to FIG. 1, there is shown the holster 10 in accordance with the preferred embodiment of the present invention. The holster 10 includes a body 12, a first clip assembly 14 and a second clip assembly 16. The body 12 has an interior 18 suitable for the receipt of a gun therein. The body 12 has a front surface 20 and a back surface 22. The first clip assembly 14 is removably affixed to one side 24 of body 12. The second clip assembly 16 is removably affixed to an opposite side 26 of the body 12. Each of the clip assemblies 14 and 16 are adjustably positioned relative to the body. Within the concept of the present invention, the clip member used with both of the clip assemblies 14 and 16 of the present invention can be substituted with the various forms of clips as identified in FIGS. 7-16.

The first clip assembly 14 has a clip member 28 and a flexible tab 30. The flexible tab 30 has one side affixed to side 24 of body 12 and an opposite side connected to the clip member 28. In particular, it can be seen that a bracket 32 is ultrasonically welded to the side 24 of the body 12. The tab 30 is removably secured to the portion of the bracket 32 that extends outwardly of side 24. The flexible tab 30 includes suitable screw holes along edge 36 thereof. The screw holes along edge 36 are suitable for allowing screw 38 and 40 to be placed therethrough and received by suitable T-nuts on the other side of the bracket 32. The flexible tab 30 also includes another screw hole located away from screw holes associated with screws 38 and 40. As can be seen, a screw 42 is placed through a hole formed at the lower end of clip member 28. Screw 42 is secured to the flexible tab 30 on the opposite side of the flexible tab. Screw holes 44 is formed are vertical alignment with the screw hole associated with screw 42 on the clip member 28. If necessary, the screw 42 can be unscrewed, the clip member 28 lowered and the screw 42 inserted into anther of the screw holes 44 so as to facilitate the adaptability of the clip member 28 as required by the user of the holster 10.

Importantly, it can be seen that reliefs 45 and 47 are formed on opposite sides of the forward surface 64 of clip assembly 14. These relief 45 and 47 have been found, experimentally, to extend the life and to prevent cracking of the plastic clip assembly. As will be described hereinafter, similar reliefs are found on the rear surface of the clip assembly 14.

It can be seen that the second clip assembly 16 also includes a clip member 46 and a flexible tab 48. The flexible tab 48 is directly secured to the opposite side 26 of body 12 through the use of screws 50 and 52. The flexible tab 48 will be specifically positioned between the front surface 20 and the back surface 22 of the body 12. The clip member 46 is secured by a screw 50 to the tab 48. Additional screw holes 51 and 53 are provided in vertical alignment with screw 50 in order to further enhance the adaptability and adjustability of the clip assembly 16. As can be seen in FIG. 1, the clip member 46 extends in an angularly offset relationship to the side 26 of the body 12 of holster 10. The angular offset of the clip member 46 can be suitably adjusted to fit the needs of the user. The clip assembly also includes reliefs 55 and 57 formed on the forward surface of clip assembly 16. These relief provide the same benefits as reliefs 45 and 47 of clip assembly 14.

In the present invention, it is important to note that the body 12 and the clip members 28 and 46 are each formed of identical rigid polymeric materials, such as KYDEX (™). The tabs 30 and 48 are suitably formed of a flexible leather material.

In FIG. 1, it can be seen that a projection 56 extends upwardly from the rear surface of body 12. Projection 56 stabilizes the holster 10 when placed against the human body and also serves to prevent the flabby surface of the body from overlapping with the upper opening 18 for the gun.

FIG. 2 shows a side view of the holster 10 of the present invention. In particular, FIG. 2 shows the clip member 28 as secured by screw 42 onto the flexible tab 30. Flexible tab 30 is also illustrated as secured to the outwardly extending portion of bracket 32. A washer 60 is interposed between the rear surface 62 of clip member 28 and the forward surface of the flexible tab 30.

The clip member 28 has a unique configuration. In particular, the clip 28 has a rear surface 62 and a forward surface 64. The rear surface 62 is resiliently connected to the forward surface 64 at juncture 66. An inwardly extending ledge 68 extends from the end of the forward surface 64 from the juncture 66 back toward the rear surface 62. An outwardly angled portion 70 extends from the inward end of the ledge 68 back outwardly and away from the rear surface 28. The belt of the wearer will be received within the interior area 72 defined by the rearward surface 62, the forward surface 64, the resilient juncture 66 and the ledge 68.

FIG. 3 illustrates how the clip member 46 is secured between the forward surface 20 and the rear surface 22 of the body 12 of holster 10. In particular, it can be seen that the flexible tab 48 has an end in threaded connection with screws 50 and 52 extending through the body 12. The clip member 46 has very similar configuration as clip member 28.

FIG. 4 illustrates the rear surface 62 of clip member 28. The configuration of clip member 28 will be virtually identical to the configuration of the clip member 46. Importantly, it can be seen that the rear surface 62 of clip member 28 has a pair of reliefs 78 and 80 formed on respective sides 82 and 84 thereof. The reliefs 78 and 80 are arcuate-shaped cut-outs formed inside 82 and 84, respectively. The reliefs 78 and 80 are positioned away from the juncture 66. Importantly, it was found that without the reliefs 78 and 80, the juncture 66 would be more prone to cracking after continual use and application of pressure. The specific configuration of the reliefs 78 and 80 (along with the reliefs 45 and 47) allows the juncture 66 to flex over a longer period of time without breaking then would be otherwise available. It should be noted that the reliefs 78 and 80 can take various configurations.

FIG. 5 shows the rear side 90 of the clip member 46. Once again, clip member 46 includes reliefs 92 and 94 of generally arcuate-shaped cut-outs. Three holes 96 is formed near the bottom of the clip member 46. Holes 96 is suitable for the receipt of a screw 50 in a select one thereof therein.

FIG. 6 illustrates the connection of the bracket 32 to the side 24 of body 12. In the present invention, it was found to be efficient, effective, sturdy and otherwise useful to ultrasonically weld the bracket 32 in position on side 24. As a result, the problems associated with adhesives in the prior art are effectively avoided. Additionally, the extra time and expense associated with the application of screws and adhesive is avoided through the use of such ultrasonic welding procedures. It was found that ultrasonic welding is particularly applicable for use in association with the rigid polymeric material of the present invention. Furthermore, the use of such ultrasonic welding greatly extends the life of the connection between the first clip assembly 14 and the body 12 of holster 10. The bracket 32 has a front surface 100 that is ultrasonically welded to side 24. Another surface 102 also has a portion ultrasonically welded to side 24. These surfaces 100 and 102 are ultrasonically welded together in the area of screw 40 such that screw 40 can secure the flexible tab 30 thereto.

FIG. 7 shows clip member 110. Clip member 110 is interchangeable with either of the clip members 28 and 46, depending on the desires of the user. Clip member 110 is designed for more concealed application onto the belt of the user. In particular, clip member 110 includes rear surface 112 and forward surface 114. A belt receptacle 116 is located on the forward surface 114. Belt receptacle 116 includes an outwardly turned portion 118 extending away from the rear surface 112 and extending upwardly for less than the length of the forward surface 114. A shelf 120 extends from the forward surface 114 away from the rear surface 112. Shelf 120 is in spaced relation to the outwardly turned portion 118.

Figure 8:
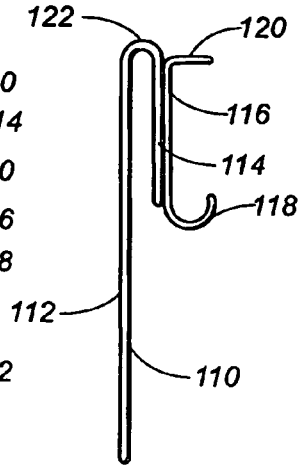
FIG. 8 is a side view of the first alternate clip used in the present invention.
Figure 9:
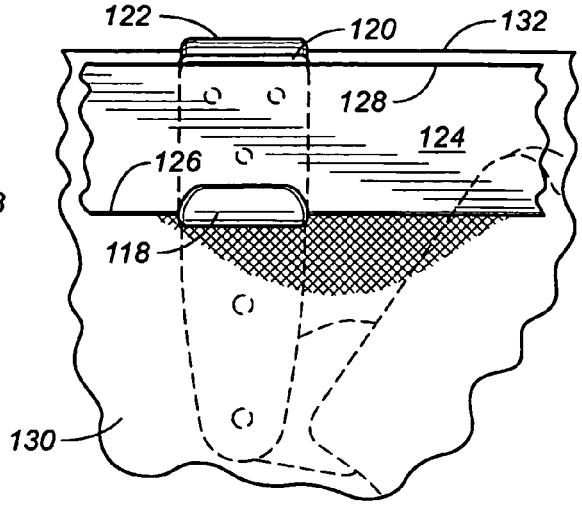
FIG. 9 is an illustration of the first alternate clip as secured to a belt.

FIG. 8 specifically illustrates the configuration of the clip member 110. As can be seen, the rear surface 112 has the forward surface 114 extending in generally parallel relationship thereto. The rear surface 112 is resiliently connected to forward surface 114 at juncture 122. The belt receptacle 116 is affixed to the forward surface 114. The outwardly turned portion 118 is formed at the bottom of the belt receptacle 116. Shelf 120 is formed of at the top of the receptacle 116 in spaced relationship to the outwardly turned portion 118. FIG. 9 shows how belt 124 is suitably received by the outwardly turned portion 118 and the shelf 120. The outwardly turned portion 118 will grip the bottom edge 126 of belt 124. The shelf 120 will reside against the upper edge 128 of belt 124. The forward surface of the clip member 110 will reside in the area between the belt 124 and the trousers 130. It can be seen that the juncture 122 will reside over the upper edge 132 of the trousers 130 and extends so that the rearward surface 112 is located within the pants.

Figure 10:
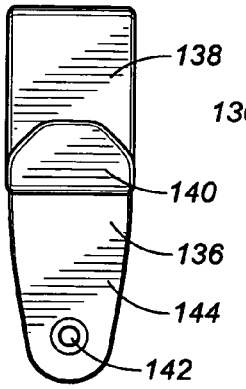
FIG. 10 is a frontal view of a second alternate clip used in the present invention.

FIG. 10 is a variation of the clip member 110. As can be seen, clip member 136 is integrally formed of a rigid polymeric material. In the clip member 136, there is no belt receptacle affixed to the forward surface 138. The outwardly turned edge 140 is simply formed at the bottom of the forward surface 138. The outwardly turned portion 140 extends upwardly for less than the length of the forward surface 138. A screw hole 142 is formed through the rear surface 144 so as to accommodate a fixing screw therein.

Figure 11:
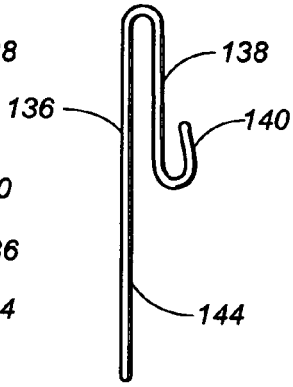
FIG. 11 is a side view of the second alternate clip used of the present invention.
Figure 12:
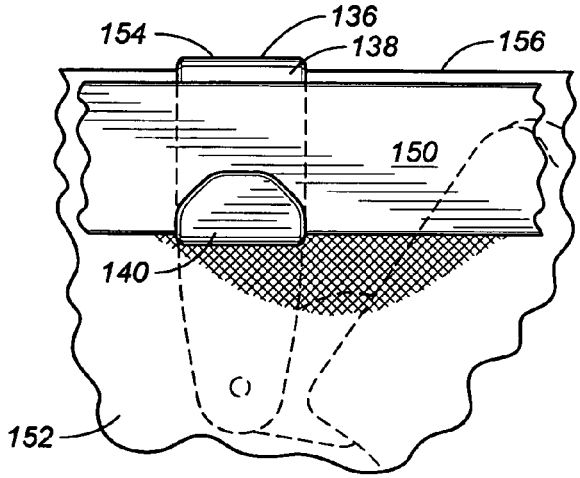
FIG. 12 is a view of the second alternate clip of the present invention as secured to a belt.

FIG. 11 shows how the rear surface 144 is in a generally flexible planar parallel relationship to the forward surface 138. The outwardly turned portion 140 extends upwardly so as to provide a portion which fixes onto the belt. In FIG. 12, it can be seen that the clip member 136 has the outwardly turned portion 140 overlapping the exterior of belt 150. The forward surface 138 will extend behind the belt 150 or extend between the belt 150 and the trouser 152. The juncture 154 of the forward surface 138 and the rearward surface 144 will overlie the top edge 156 of trousers 152.

Figure 13:
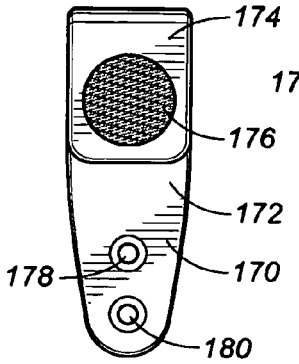
FIG. 13 is a frontal view of a third alternate clip of the present invention.

FIG. 13 shows clip 170. Clip 170 is of a style that can be used in place of any previously described clips in association with the holster 10 of the present invention. Clip 170 is specifically designed for fully concealed use. Only minimal portions of clip 170 will be visible from the exterior of the wearer. As can be seen, clip 170 includes a rearward surface 172 and a forward surface 174. A section of hook-and-loop material 176 is affixed to the forward surface 174. This strip of hook-and-loop material is commonly known as VELCRO (™). The section 176 can be of either the loop material or the hook material. The section 176 will engage a complementary hook-and-loop material located on the interior surface of the belt. A pair of screw holes 178 and 180 are formed on the rear surface 172 for attachment, as desired, to the flexible tabs 30 and 48 of the holster 10.

Figure 14:
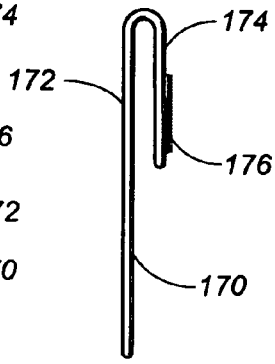
FIG. 14 is a side view of this third alternate clip of the present invention.
Figure 15:
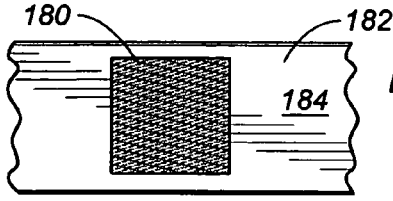
FIG. 15 is a back side view of a belt as used with the third alternate form of the clip of the present invention.
Figure 16:
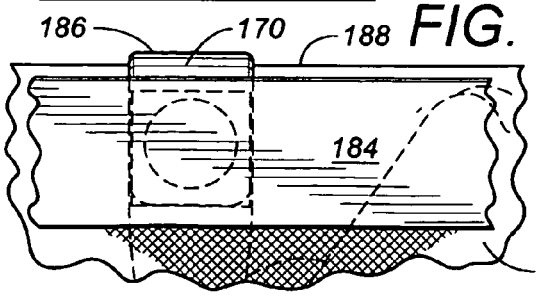
FIG. 16 illustrates the third alternate form of the clip of the present invention as used in association with a belt.

FIG. 14 shows how the clip member 170 has the forward surface 174 in generally flexible parallel planar relationship with the rear surface 172. The section 176 of hook-and-loop material faces away from the rear surface 172. FIG. 15 shows how the complementary section 180 of hook-and-loop material is affixed to the rear surface 182 of belt 184. FIG. 16 shows that when the clip member 170 is secured such that the section 176 engages 180, virtually all of the clip member is obscured from exterior view. Only the juncture 186 of the forward surface 174 and the rearward surface 172 will be slightly visible as it overlies the top edge 188 of trouser 190.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A holster for a gun comprising:

a body having an interior suitable for receipt of a gun therein, said body having a front surface and a back surface;

a belt-receiving first clip assembly removably affixed to one side of said body; and a belt-receiving second clip assembly removably affixed to an opposite side of said body, said first and second clip assemblies adjustably positioned relative to said body, each of said first and second clip assemblies compressing:

a clip member; and a flexible tab having a side connected to said clip member, said first clip assembly comprising a bracket ultrasonically welded to said one side of said body, said flexible tab being secured to a portion of said bracket extending outwardly of said one side of said body, said clip member secured by a screw to said flexible tab, said flexible tab secured by a pair of screws to said portion of said bracket.

2. The holster of claim 1, said flexible tab being of a leather material.

3. The holster of claim 1, said flexible tab of said second clip assembly secured between said front surface and said back surface of said body.

4. A holster for a gun comprising:

a body having an interior suitable for receipt of a gun therein, said body having a front surface and a back surface;

a belt-receiving first clip assembly removably affixed to one side of said body; and a belt-receiving second clip assembly removably affixed to an opposite side of said body, said first and second clip assemblies adjustably positioned relative to said body, each of said first and second clip assemblies compressing:

a clip member; and a flexible tab having a side connected to aid clip member, said clip member having a rear surface secured to said flexible tab, said clip member having a forward surface extending in generally parallel relationship to said rear surface, each of said forward surface and said rear surface having a relief formed therethrough and spaced from a resilient junction of said forward surface and said rear surface, said relief being a pair of arcuate-shaped cut-outs formed along respective opposite sides of the respective surface.

5. The holster of claim 4, said clip member having an inwardly extending ledge extending from a bottom of said forward surface back toward said rear surface, said clip member having an outwardly angled portion extending from said ledge back away from said rear surface.

6. The holster of claim 4, said rear surface having a lower portion affixed to said tab, said lower portion of said rear surface having three holes vertically aligned and formed therethrough.

7. The holster of claim 4, said first clip assembly in generally parallel relationship to said one side of body, said second clip assembly extending in an offset angular relationship to said opposite side of said body.

8. The holster of claim 4, each of said first and second clip assemblies having a clip member, said body and said clip members being formed of a rigid polymeric material.

* * * * *